US010426692B2

(12) United States Patent
Jurna et al.

(10) Patent No.: US 10,426,692 B2
(45) Date of Patent: Oct. 1, 2019

(54) SKIN TREATMENT APPARATUS AND METHOD FOR THE SAME

(71) Applicant: KONINKLIJKE PHILIPS N.V., Eindhoven (NL)

(72) Inventors: Martin Jurna, Eindhoven (NL); Margaret Ruth Horton, Eindhoven (NL); Yan Liu, Eindhoven (NL); Jonathan Alambra Palero, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 653 days.

(21) Appl. No.: 14/419,491

(22) PCT Filed: Jul. 29, 2013

(86) PCT No.: PCT/IB2013/056188
§ 371 (c)(1),
(2) Date: Feb. 4, 2015

(87) PCT Pub. No.: WO2014/024084
PCT Pub. Date: Feb. 13, 2014

(65) Prior Publication Data

US 2015/0190299 A1 Jul. 9, 2015

Related U.S. Application Data

(60) Provisional application No. 61/679,845, filed on Aug. 6, 2012.

(51) Int. Cl.
*A61H 7/00* (2006.01)

(52) U.S. Cl.
CPC ..... *A61H 7/005* (2013.01); *A61H 2201/1215* (2013.01); *A61H 2201/1671* (2013.01);
(Continued)

(58) Field of Classification Search
CPC ..... A61H 7/005; A61H 2201/5028; A61H 2201/5084; A61H 2201/5058;
(Continued)

(56) References Cited

U.S. PATENT DOCUMENTS 4,027,348 A * 6/1977 Flowers ..... A46B 13/02 15/22.1
5,569,168 A * 10/1996 Hartwig ..... A61H 7/005 601/103

(Continued)

FOREIGN PATENT DOCUMENTS

EP 1113385 A2 7/2001

*Primary Examiner* — Tu A Vo

(57) ABSTRACT

A skin treatment apparatus (1) for treating a skin surface, comprising: a hand held base body (10); a rotor head (20), movably connected to the base body (10), and including at least one skin contacting element (22); a motor (30), operably connected to both the base body (10) and the rotor head (20) to rotatably drive the rotor head (20) relative to the base body (10) around a rotation axis (L); at least one motion sensor (40) to generate a movement signal reflecting a path of relative movement between the motion sensor and the skin surface; and a control unit (50), operably connected to the at least one motion sensor (40) and the motor (30) to control the motor (30) to rotatably drive the rotor head (20) in dependence of the movement signal of the at least one motion sensor (40).

15 Claims, 3 Drawing Sheets

(52) U.S. Cl.
CPC .... *A61H 2201/50* (2013.01); *A61H 2201/503* (2013.01); *A61H 2201/5005* (2013.01); *A61H 2201/5025* (2013.01); *A61H 2201/5028* (2013.01); *A61H 2201/5038* (2013.01); *A61H 2201/5058* (2013.01); *A61H 2201/5084* (2013.01); *A61H 2201/5092* (2013.01); *A61H 2201/5097* (2013.01)

(58) Field of Classification Search
CPC .... A61H 2201/5038; A61H 2201/5025; A61H 2201/5092; A61H 2201/50; A61H 2201/1671; A61H 2201/1215; A61H 2201/5097; A61H 2201/503; A61H 2201/5005; A61H 7/00; A61H 7/001; A61H 7/002; A61H 7/003; A61H 7/004; A61H 7/007
See application file for complete search history.

(56) References Cited

U.S. PATENT DOCUMENTS 6,252,394 B1 6/2001 Roze
6,433,780 B1 8/2002 Gordon
7,789,092 B2 * 9/2010 Akridge ..... A61B 17/50 132/200
8,484,788 B2 * 7/2013 Brewer ..... A46B 9/06 15/22.1
2002/0183959 A1 * 12/2002 Savill ..... A46B 15/0002 702/150
2003/0212354 A1 * 11/2003 Kahn ..... A61H 7/002 601/99
2005/0100555 A1 5/2005 Pitzalis et al.
2005/0278876 A1 * 12/2005 Roth ..... A46B 13/06 15/28
2006/0100555 A1 * 5/2006 Cagle ..... A61H 7/008 601/6
2006/0168746 A1 * 8/2006 Guyuron ..... A47K 7/04 15/97.1
2007/0005047 A1 1/2007 Ferren
2007/0038206 A1 * 2/2007 Altshuler ..... A61B 18/203 606/20
2007/0123808 A1 * 5/2007 Rhoades ..... A45D 24/007 601/73
2008/0200849 A1 * 8/2008 Hollington ..... A61H 15/0078 601/46
2008/0221504 A1 * 9/2008 Aghion ..... A61H 7/008 604/20
2009/0177125 A1 * 7/2009 Pilcher ..... A46B 15/0034 601/18
2011/0087141 A1 * 4/2011 Wagy ..... A61H 15/0085 601/137
2012/0165710 A1 * 6/2012 Nichols ..... A61H 7/005 601/72
2013/0060176 A1 * 3/2013 Nichols ..... A46B 13/023 601/137
2013/0079689 A1 * 3/2013 Thierman ..... A61H 39/08 601/46

* cited by examiner

SKIN TREATMENT APPARATUS AND METHOD FOR THE SAME

This application is the U.S. National Phase application under 35 U.S.C. § 371 of International Application No. PCT/IB2013/056188, filed on Jul. 29, 2013, which claims the benefit of U.S. Provisional Application No. 61/679,845 filed on Aug. 6, 2012. These applications are hereby incorporated by reference herein.

FIELD OF THE INVENTION

The present invention relates to an apparatus including a rotor head with at least one skin contacting element for rotary contact with, and hence cosmetic treatment of, the skin. The present invention also relates to a method of treating a skin surface through rotary contact of a skin contacting element with said skin surface.

BACKGROUND OF THE INVENTION

Apparatus for cosmetic treatment of the skin are known in the art. Some may include a hand-held base body, and a rotor head that is movably connected to the base body and includes a skin contacting element, such as a brush, a microdermabrasion surface or a massaging surface. During operation a user may manually hold the base body, bring the skin contacting element in contact with a portion of his skin, and then activate the rotor head to cause a rotary movement of the skin contacting element. Depending on the nature of the skin contact element, its action on the skin may serve to, inter alia, clean, rejuvenate, exfoliate and massage the skin.

SUMMARY OF THE INVENTION

One drawback associated with known skin treatment apparatus is the often uni-directional rotary motion of the skin contacting element. Such motion, which causes the element to asymmetrically tug and pull the skin, may damage the skin's structure, e.g. its elastin fibers, and provoke a loss of elasticity. This applies in particular to areas that are naturally sensitive to tensile and compressive stresses, such as the relatively thin skin around the eyes (periocular area). Known apparatus that avoid the asymmetrical loading of the skin may typically employ a high-frequency (>100 Hz) oscillatory (i.e. bi-directional) motion of the skin contacting element instead. Such rapid oscillatory motion, however, may be perceived as uncomfortable.

Another drawback associated with known skin treatment apparatus is that the motion of the skin contacting element is rather different from the typical intuitive finger or hand motion a person is inclined to use when massaging his own skin or applying a cream thereto. This intuitive finger motion may include successive small circle-like movements continuously executed along a larger circular path. Compared to this instinctive motion of the finger(s), the typically invariably rotating motion of the skin contacting element of known skin treatment apparatus may provide for an unnatural experience.

It is an object of the present invention to provide for a skin treatment apparatus and a method of treating a skin surface that avoid uni-directional loading of the skin, and that enable a variably rotating motion of the skin contacting element capable of mimicking the natural, intuitive finger motion used for, inter alia, self-massage.

To this end, a first aspect of the present invention is directed to a skin treatment apparatus for treatment of a skin surface. The apparatus may include a hand-held base body, a rotor head that is movably connected to the base body and that includes at least one skin contacting element, and a motor that is operably connected to both the base body and the rotor head and that is configured to rotatably drive the rotor head relative to the base body around a rotation axis. The apparatus may further include at least one motion sensor configured to generate a movement signal reflecting a path of relative movement between the hand-held base body and the skin surface, and a control unit that is operably connected to the at least one motion sensor and the motor and that is configured to control the motor to rotatably drive the rotor head in dependence of the movement signal of the at least one motion sensor.

The skin treatment apparatus according to the present invention provides for automatic interactive control over the rotary motion of the rotor head, based on the relative motion between the apparatus and the skin surface being treated. That is, the rotary motion of the rotor head is not invariable or rigidly pre-programmed in time, but may vary depending on how a user intuitively moves the apparatus across his skin during use. Accordingly, the control unit may tie the rotary motion of the rotor head in with the motion of the hand of the user operating the device so as to provide a more natural skin treatment experience.

In a preferred embodiment, the control unit may be configured to distinguish between a plurality of predetermined paths of relative movement that are optionally (that is, depending on what movements are imposed upon the apparatus by the user) reflected in the movement signal; to associate with each of said distinguished predetermined paths of relative movement a rotor head movement pattern; to repeatedly analyze the movement signal, and, once a distinguished predetermined path of relative movement is detected during said analysis, to rotatably drive the rotor head in accordance with the respective associated rotor head movement pattern. It is understood that the repeated or periodic analysis of the movement signal may be performed on time wise successive portions of the movement signal each covering a certain, optionally fixed time interval of limited duration. The duration of a time interval may preferably be less than 1 second, and more preferably less than 0.5 seconds, e.g. 0.25 seconds.

Paths of relative movement between the apparatus and the skin surface being treated may be distinguished based on differences in, inter alia, their shapes and/or differences in their orientations/directions and/or differences in the speed with which they are executed.

In one embodiment, for instance, the control unit may be configured to distinguish substantially linear paths of relative movement. In an elaboration of this embodiment, the control unit may further be configured to distinguish between linear paths of relative movement in different directions with respect to a predetermined coordinate system fixed to the apparatus. In another embodiment, the control unit may be configured to distinguish substantially circular paths of relative movement, and in an elaboration of this embodiment the control unit may further distinguish between clockwise and counter-clockwise circular paths of relative movement. It is understood that distinguishable paths of relative movement are not limited to those with a linear or circular shape; in some other embodiments, for example, the control unit may be configured to detect elliptically curved and/or other non-linear paths of relative movement.

A single rotor head movement pattern may typically entail one of: clockwise rotation of the rotor head around its rotation axis, counter-clockwise rotation of the rotor head around its rotation axis, and alternate clockwise and counter-clockwise rotation (i.e. oscillatory motion) of the rotor head around its rotation axis. Other parameters that may supplementarily define a rotor head movement pattern may include a frequency of rotation (i.e. the number of revolutions/rotations per unit of time), a frequency of oscillation, and an angle of oscillation. Frequencies of rotation and oscillation may preferably be in the range of 0.1-100 Hz.

Different rotor head movement patterns may differ in at least one of the aforementioned aspects. For example, a first rotor head movement pattern may entail clockwise rotation of the rotor head around its rotation axis at a frequency of 10 Hz; a second rotor head movement pattern may entail counter-clockwise rotation of the rotor head around its rotation axis at a frequency of 10 Hz; and a third rotor head movement patter may entail oscillatory motion of the rotor head around its rotation axis at a frequency of 5 Hz with an angle of oscillation of 180°.

The selection of a rotor head movement pattern may preferably be based on user hand-induced paths of relative movement between the apparatus and the skin surface, or phrased otherwise, on relative motion between the hand-held base body of the apparatus and the skin surface. Although it is possible to fixedly connect the at least one motion sensor to the rotatably drivable rotor head, and to infer from its movement signal the relative motion between the base body and the skin surface, such an embodiment may put high demands on the processing power of the control unit as it must be capable of differentiating between displacement components in the movement signal related to (i) the externally or hand-induced movements of the base body, and (ii) the internally or motor-induced movements of the rotor head relative to the base body. To avoid this, in a preferred embodiment of the apparatus the at least one motion sensor may be statically arranged relative to the base body, such that the movement signal generated by the at least one motion sensor substantially exclusively reflects externally or hand-induced displacements of the base body, and thus substantially excludes displacement contributions due to rotating motions of the rotor head.

A second aspect of the present invention is directed to a method of treating a skin surface through rotary contact of a skin contacting element with said skin surface. The method may include providing a skin treatment apparatus. The skin treatment apparatus may comprise a hand-held base body and a rotor head. The rotor head may be movably connected to the base body such that is rotatable relative to the base body around a rotation axis. The rotor head may comprise at least one skin contacting element. The method may further include moving the hand-held base body relative to the skin surface, and generating a movement signal that reflects a path of relative movement between the hand-held base body and the skin surface. In addition, the method may include rotatably driving the rotor head in rotation around its rotation axis in dependence of the movement signal, while the skin contacting element touches the skin surface.

According to an elaboration of the invention, the method may further comprise distinguishing a plurality of predetermined paths of relative movement optionally reflected in the movement signal; associating with each of said distinguished predetermined paths of relative movement a rotor head movement pattern; repeatedly analyzing the movement signal, and, once a distinguished predetermined path of relative movement is detected during said analysis, rotatably driving the rotor head in accordance with the respective associated rotor head movement pattern.

It is understood that elaborations of the present invention discussed in this text with reference to the structure and operation of the apparatus according to the first aspect of the present invention are, mutatis mutandis, applicable to the method according to the second aspect of the present invention.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1A:
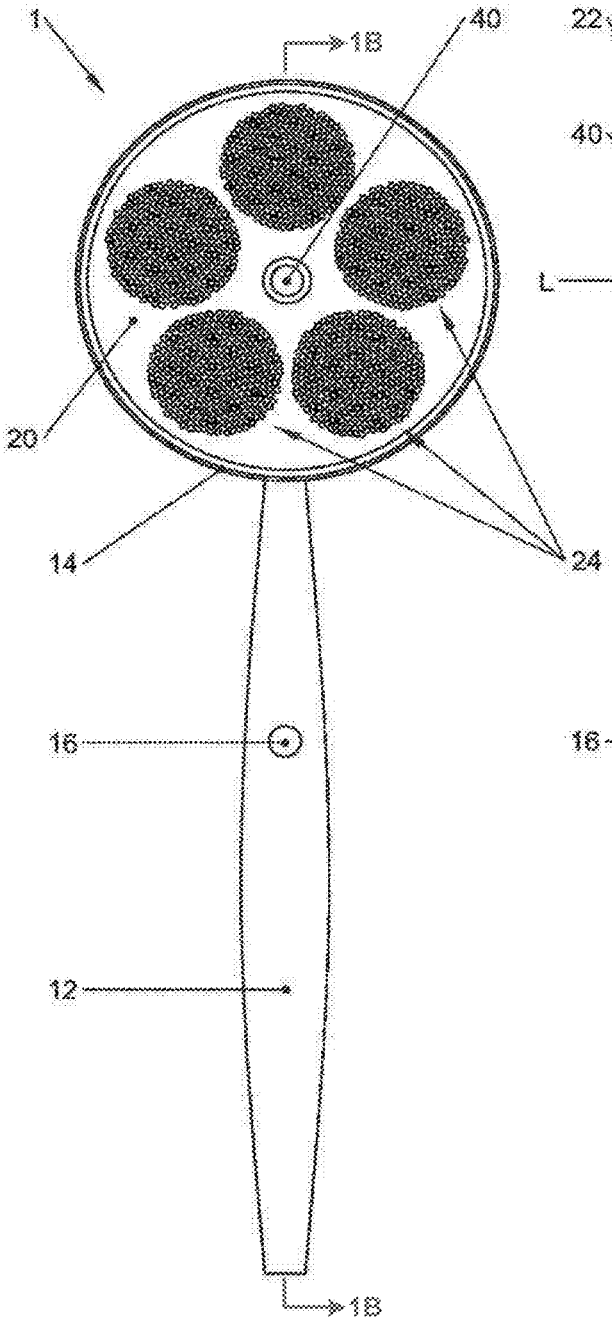
FIG. 1A is a schematic front view of an exemplary skin treatment apparatus according to the present invention.
Figure 1B:
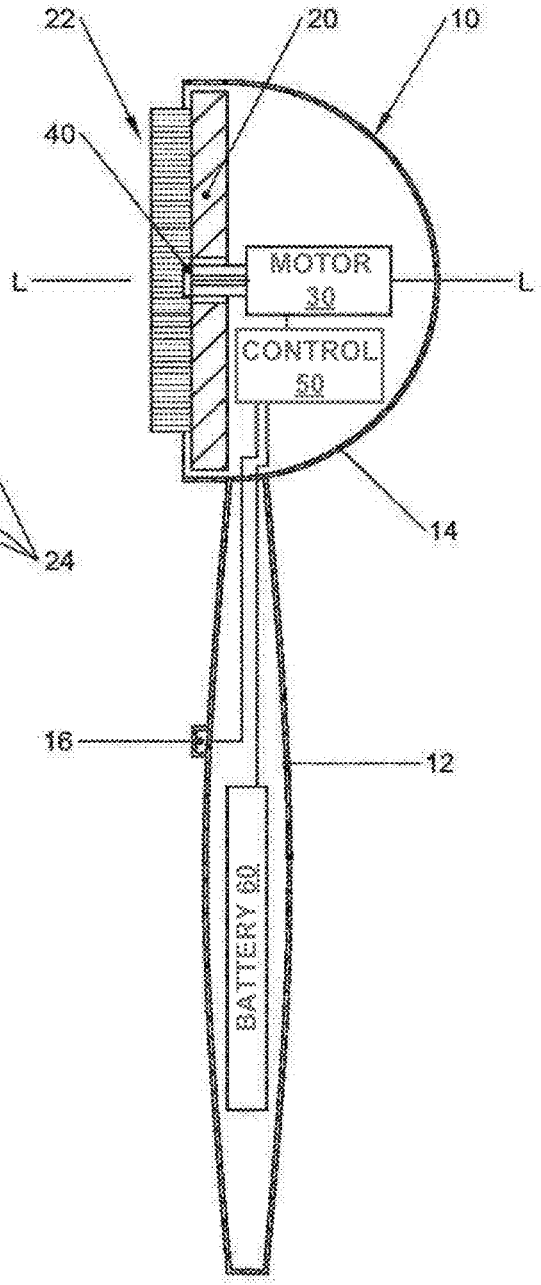
FIG. 1B is a schematic cross-sectional side view of the skin treatment apparatus shown in FIG. 1A.

FIGS. 1A and 1B schematically illustrate an exemplary skin treatment apparatus 1 according to the present invention in a front view and a cross-sectional side view, respectively.

The skin treatment apparatus 1 may include a rigid, hollow hand-held base body 10, defining an elongate handle portion 12 and a substantially semi-spherical rotor head housing portion 14 connected to an end thereof.

The rotor head housing portion 14 may accommodate a generally disc-shaped rotor head 20. The rotor head 20 may be movably mounted within the rotor head housing 14, such that it substantially covers an open side of the semi-spherical rotor head housing portion 14, and such that it is rotatable around a central rotation axis L. On an outward facing side, the rotor head 20 may be provided with at least one skin contacting element 22. In the depicted embodiment, the at least one skin contacting element 22 includes a plurality of bristle tufts 24 that are regularly spaced apart around the rotation axis L; in other embodiments, the skin contact element 22 may be different, and for instance include an abrasive microdermabrasion surface, or a generally smooth massaging surface. Although the depicted embodiment includes a rotor head 20 with only one independently rotatable part, it is understood that other embodiments may include a rotor head with multiple, optionally independently rotatably drivable parts. In an elaboration of the depicted embodiment, for instance, each of the bristle tufts 24 may be provided on a respective sub-rotor head. Each such sub-rotor head may be excentrically connected to the primary disc-shaped rotor head 20 shown in FIGS. 1A and 1B, and be independently rotatable relative thereto around a sub-rotation axis of the respective sub-rotor head, which sub-rotation axis may be parallel to the central rotation axis L of the primary rotor head 20 without coinciding therewith. Accordingly, each sub-rotor head/bristle tuft 24 may be driven in rotation around its respective sub-rotation axis, while it may additionally be rotated along a circular path as a result of the rotation of the primary rotor head 20. The rotor head housing portion 14 may further accommodate a motor 30, in particular an electromotor, that is operably connected to both the rotor head housing portion 14 and the rotor head 20, and configured to rotatably drive the rotor head 20 relative to the base body 10 around its rotation axis L. In a preferred embodiment, the motor 30 may be a stepper motor in order to facilitate accurate control over variations in rotational direction and speed of the rotor head 20.

The skin treatment apparatus 1 may also include at least one motion sensor 40 configured to generate a movement signal reflecting a path of relative movement between the motion sensor and a skin surface. In a preferred embodiment the motion sensor 40 may be statically arranged relative to, e.g. be immediately connected to, the hand-held base body 10 (instead of to the rotor head 20), to as to ensure that the movement signal generated by the motion sensor 40 substantially exclusively reflects user hand-induced displacements of the base body, and thus substantially excludes displacement contributions to rotation motions of the rotor head 20.

The motion sensor 40 may in itself be of a conventional design, and of any suitable type. In one embodiment the motion sensor 40 may be a tracking device, such that it is configured to generate its movement signal in accordance with movements across a skin surface detected via interaction therewith. The tracking device may be similar to tracking devices known from the field of computer input devices, e.g. computer mice, and for instance be a mechanical tracking device, such as a rollerball tracking device, or an optical tracking device. In a skin treatment apparatus 1 fitted with a roller ball tracking device, a small ball may roll over the skin surface, while displacement sensors register the mutually perpendicular x/y-displacements of the ball; in an apparatus 1 fitted with an optical tracking device, optical images of the skin surface, taken at high frame rates, may be compared to each other to determine the mutually perpendicular x/y-shifts between them. An optical tracking device may be preferable to a mechanical tracking device for its higher reliability and accuracy. Alternatively, or in addition, the motion sensor 40 may be configured to generate its movement signal in accordance with movements detected without interaction with the skin surface. In such an embodiment the motion sensor may, for instance, include an accelerometer that may determine mutually perpendicular displacements from accelerations measured during certain time intervals. In another such embodiment, the motion sensor 40 may include an optical, e.g. infrared, sensor that is not mechanically connected to the hand-base body 10 and disposed outside thereof. The motion sensor may be configured to track the motion of the hand-held base body 10 in three dimensional space, and to wirelessly transmit coordinates of a path of movement of the hand-held base body 10 to the control unit 50.

In general, the motion sensor 40 may preferably provide displacement information at a frequency about at least 60 Hz, so as to ensure that both linear and circular movements are detectable within small portions of the movement signal having durations on the order of a second or smaller.

In the embodiment depicted in FIGS. 1A and 1B, the motion sensor 40 is an optical tracking device, fixedly arranged to the hand-held base body 10 at the center of disc-shaped rotor head 20.

The skin treatment apparatus may further include a control unit 50 that is operably connected to the at least one motion sensor 40 and the motor 30, and configured to control the motor 30 to rotatably drive the rotor head around its rotation axis L in dependence of the movement signal from the motion sensor 40 in a manner to be discussed below.

The electrical components of the skin treatment apparatus 1, such as the electromotor 30 and the control unit 50, may be provided with electrical power from a battery 60, which may be accommodated in the elongate handle portion 12 of the hand-held base body 10.

The apparatus 1 may be controlled, e.g. switched on and off, via one or more user controls 16 provided on the handle portion 12 hand-held base body 10.

Now that the construction of the skin treatment apparatus 1 according to the present invention has been elucidated, attention is invited to its operation.

During use, a user may hold the hand-held base body 10 of the apparatus 1 such that the skin contacting element 22 mounted on the rotor head 20 touches his skin, and then move the apparatus 1 relative thereto. In response to the relative movement, the motion sensor 40 may generate a movement signal that reflects the path of relative movement between the apparatus 1 and the skin surface. The control unit 50 may periodically analyze a respective portion of the movement signal of a certain duration, so as to each time determine whether one of a predetermined plurality of distinguished paths of relative movement is being executed. When a distinguished path of relative movement is detected, it may rotatably drive the rotor head 20 in accordance with a respective associated rotor head movement pattern.

The relative motion between the skin treatment apparatus 1 and the generally three-dimensional skin surface being treated may be analyzed and described both theoretically and within the internals of the control unit 50 in terms of any suitable set of coordinates and with reference to any suitable coordinate system.

In order not to complicate the exposition, however, and without loss of generality, the operation of the skin treatment apparatus 1 according to the present invention is expounded here in relation to a generally flat, i.e. two-dimensional, skin surface. This approach is sensible because even though the overall skin surface being treated may in actuality be three-dimensionally curved, the control unit 50 of the apparatus 1 may typically be configured to repeatedly determine the relative direction of motion in relation to only a relatively small portion thereof, which respective portion may each time be approximated by a two-dimensional patch.

Where the paths of relative movement to be distinguished and detected by the control unit 50 include linear and/or circular paths, the relative movements between the apparatus and a generally flat (patch of) skin surface may further be conveniently describable with reference to a two-dimensional polar coordinate system in which each point is determined by a distance measured from a fixed point called the pole, and an angle measured from a fixed direction called the polar axis. The distance from the pole is called the radial coordinate or radius R, and the angle from the fixed direction is called the angular coordinate or polar angle θ. When using a polar coordinate system to describe the relative movements between the apparatus 1 and the skin surface, a movement signal from the motion sensor 40 may be construed to define a path of relative movement, every point of which is determined by a pair of coordinates (R, θ). In the leftmost diagrams of FIGS. 2 and 3, the polar coordinates R and θ are indicated in a coordinate system that is imaginarily fixed to the base body 10. It is understood that the position of the pole and the orientation of the polar axis may each time be selected as desired in the analysis of a certain portion of the movement signal.

Paths of relative movement may generally be distinguished based on differences in, inter alia, their shapes and/or differences in their orientations/directions and/or differences in the speed with which they are executed.

In one embodiment, for instance, the control unit 50 may be configured to distinguish substantially linear paths of relative movement. Within a polar coordinate system with a suitably selected pole position (i.e. a pole position on said path), such a linear path of relative movement may be describable as a path along which the angular coordinate .theta. is substantially constant while the radial coordinate R varies. Here, 'is substantially constant' may be construed to mean 'variable by less than a certain relatively small threshold angle', e.g. a threshold angle 10.degree. In an elaboration of this embodiment, the control unit 50 may further be configured to distinguish between linear paths of relative movement in different directions or angular coordinate ranges. Such predetermined angular coordinate ranges may, for instance, include eight identical 45.degree.-ranges or 'sectors' (cf. the embodiments of FIGS. 3A-2C to be discussed below), together covering 360.degree., and linear movements within each sector may be identified and distinguished as such.

In another embodiment, the control unit 50 may be configured to distinguish substantially circular paths of relative movement. Within a polar coordinate system with a suitably selected pole position (i.e. a pole position at the center of curvature), such a circular path of relative movement may be describable as a path along which the angular coordinate θ varies while the radial coordinate R is substantially constant. Here, 'is substantially constant' may be construed to mean 'variable by less than a certain relatively small threshold deviation', e.g. a relative deviation of ±10% of the maximum radius value of a point along the path of relative movement, or a certain absolute deviation, e.g. 1 mm. In an elaboration of this embodiment, the control unit 50 may further distinguish between clockwise and counter-clockwise circular paths of relative movement for which the angular coordinate θ along the path, respectively, consistently decreases and increases, or vice versa.

Each distinguished path of relative movement may be coupled to one of a plurality of rotor head movement patterns. A single rotor head movement pattern may typically entail one of the following basic rotary movements: clockwise rotation of the rotor head 20 around its rotation axis L, counter-clockwise rotation of the rotor head 20 around its rotation axis L, and alternate clockwise and counter-clockwise rotation (i.e. oscillatory motion) of the rotor head 20 around its rotation axis L. Other parameters that may supplementarily define a rotor head movement pattern may include a frequency of rotation (i.e. the number of revolutions/rotations per unit of time), a frequency of oscillation, and an angle of oscillation. Frequencies of rotation and oscillation may preferably be in the range of 0.1-100 Hz.

Since both the paths of relative movement distinguished by the control unit 50 and the associated rotor head movements patterns may differ for different embodiments, the number of possible configurations is virtually endless. By way of example, the exemplary operational configurations are illustrated below with reference to Table 1 and FIGS. 2A-2C, and Table 2 and FIGS. 3A-3C, respectively.

Figures 2A, 2B, 2C:
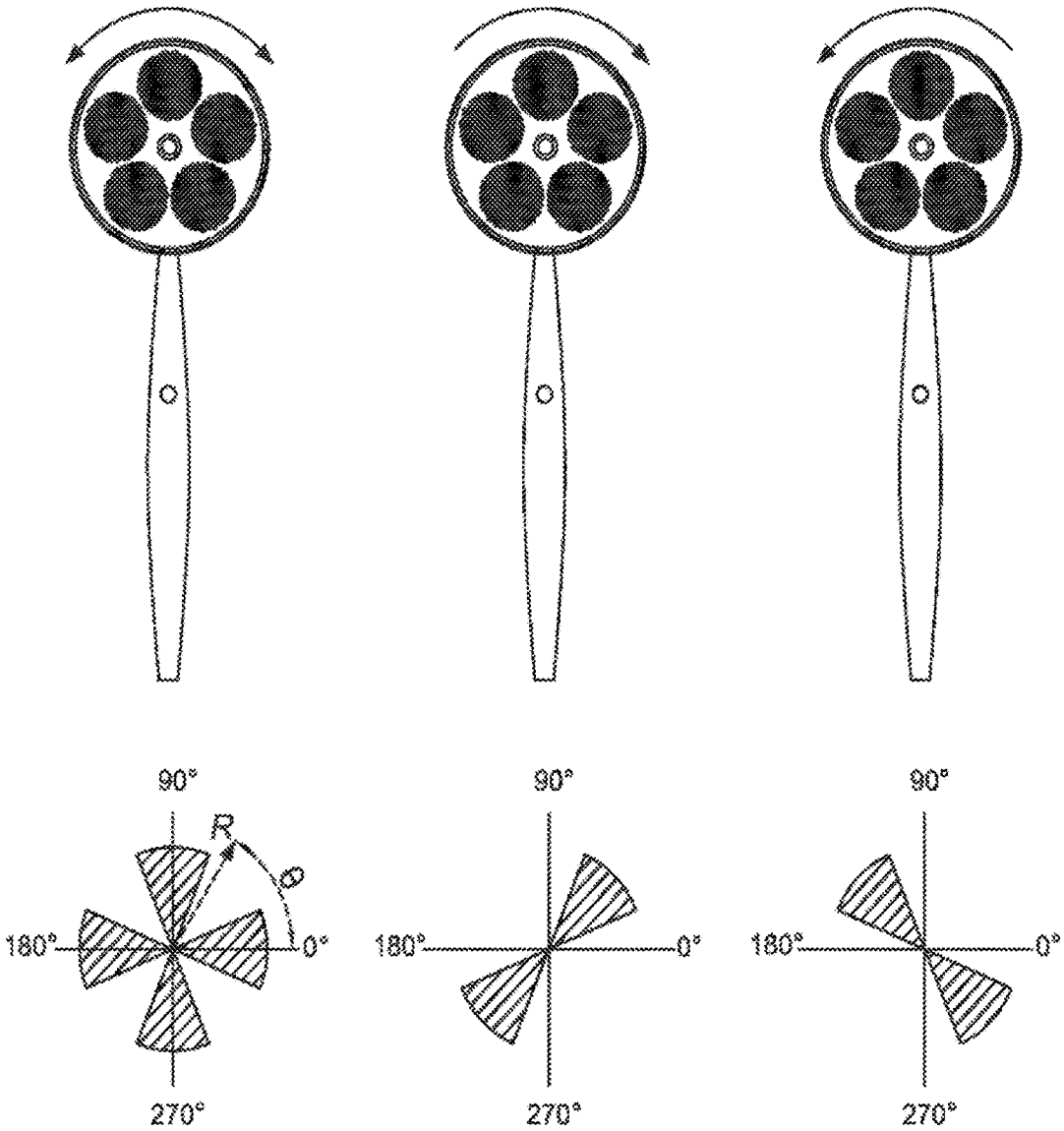
FIGS. 2A-2C schematically illustrate a first exemplary operational configurations of the skin treatment apparatus shown in FIGS. 1A and 1B, wherein paths of relative movement within certain predetermined angular ranges are associated with respective rotor head movement patterns.

In the operational configuration of Table 1 and FIGS. 2A-2C the control unit 50 provides for three different rotor head movement patterns, each of which is associated with a plurality of angular ranges/directions defined with respect to a polar coordinate system that is imaginarily fixed to the base body 10 of the apparatus 1. When the control unit detects a path of relative movement by a nonzero variation in the radial coordinate R along said path, it selects the rotor head movement pattern associated with the angular range/direction in which the relative movement took place for execution. For instance, when the control unit 50 detects a linear relative movement confined to the angular ranges 90°±22.5° and/or 270°±22.5°, it may control the motor 30 to rotatably drive the rotor head 20 into an oscillatory motion, having an oscillation angle in the range of 0°-180°, and a frequency of oscillation in the range of 0.1-100 Hz; this is illustrated in FIG. 2A. Similarly, when the control unit 50 detects a relative movement confined to the angular ranges of 45°±22.5 and/or 22.5°±22.5°, it may control the motor 30 to rotatably drive the rotor head 20 into an clockwise rotating motion around its rotation axis L having a frequency of rotation in the range of 0-100 Hz; this is illustrated in FIG. 2B, and when the control unit 50 detects a relative movement confined to the angular ranges of 135°±22.5° and/or 315°±0.22.5°, it may control the motor 30 to rotatably drive the rotor head 20 into an counterclockwise rotating motion around its rotation axis L, having a frequency of rotation in the range of 0.1-100 Hz; this is illustrated in FIG. 2C.

TABLE 1

First exemplary operational configuration, defined by a set of distinguished paths of relative movement and associated rotor head movement patterns.

| Distinguished path of relative movement | | Rotor head movement pattern | |
|---|---|---|---|
| Angular range(s) | R | Basic movement | Supplemental parameters |
| (0°, 90°, 180°, 270°) ± 22.5° | Variation | Oscillation | Oscillation angle (0°-180°) Frequency (0.1-100 Hz) |
| (45°, 225°) ± 22.5 | Variation | CW rotation | Frequency (0.1-100 Hz) |
| (135°, 315°) ± 22.5 | Variation | CCW rotation | Frequency (0.1-100 Hz) |

Figures 3A, 3B, 3C:
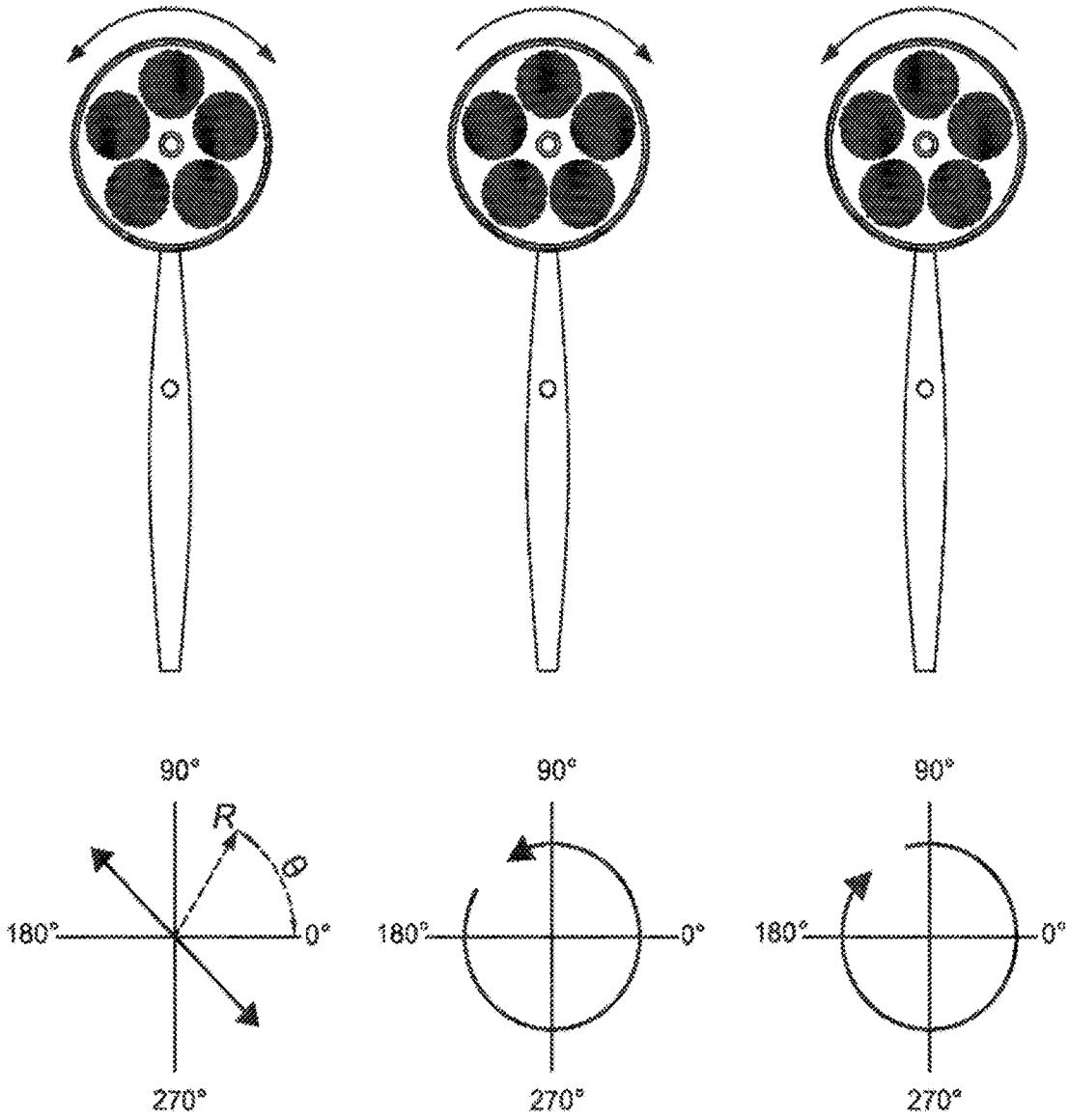
FIGS. 3A-3C schematically illustrate a second exemplary operational configurations of the skin treatment apparatus shown in FIGS. 1A and 1B, wherein substantially linear and circular paths of relative movement are associated with respective rotor head movement patterns.

In the alternative configuration of Table 2 and FIGS. 3A-3C, the control unit provides for the same rotor head movement patterns as in the configurations of Table 1 and FIGS. 2A-2C. The distinguished paths of relative movement, however, differ. The control unit 50 distinguishes between approximately linear paths of relative movement, which are describable as paths along which the radial coordinate R varies while the angular coordinate is approximately constant (which may, for instance, mean that a change $|\Delta\Theta|$ in the angular coordinate Θ does not exceed 10°), and substantially circular paths, which are describable as paths along which the radial coordinate R is approximately constant while the angular coordinate consistently increases or decreases. Hence, when the control unit 50 in analyzing the movement signal from the motion sensor 40 detects a path of relative movement that, after selection of a suitable pole position for the polar coordinate system, is describable as a path along which the angular coordinate Θ consistently increases while the radial coordinate R remains approximately constant, it may control the motor 30 to rotatably drive the rotor head 20 into a clockwise rotating motion around its rotation axis L, having a frequency of rotation in the range of 0.1-100 Hz; this is illustrated by FIG. 3B, or alternatively the path of relative movement is describable as a path along which the angular coordinate Θ consistently decreases while the radial coordinate R remains approximately constant, it may control the motor 30 to rotatably drive the rotor head 20 into a counterclockwise rotating motion around its rotation axis L, having a frequency of rotation in the range of 0.1-100 Hz; this is illustrated by FIG. 3C, or alternatively the path of relative movement is describable as a path along which the angular coordinate Θ oscillatory increases and decreases while the radial coordinate R remains approximately constant, it may control the motor 30 to rotatably drive the rotor head 20 into a oscillatory rotating motion around its rotation axis L, having a frequency of rotation in the range of 0.1-100 Hz, this is illustrated by FIG. 3A.

TABLE 2

Second exemplary operational configuration, defined by a set of distinguished paths of relative movement and associated rotor head movement patterns.

| Distinguished path of relative movement | | Rotor head movement pattern | |
|---|---|---|---|
| | | Basic | Supplemental |
| θ | R | movement | parameters |
| Approximately constant, e.g. $\lvert\Delta\theta\rvert < 10°$ | Variation | Oscillation | Oscillation angle (0°-180°) Frequency (0.1-100 Hz) |
| Consistent increase, e.g. $\lvert\Delta\theta\rvert > 10°$ | Approximately constant | CW rotation | Frequency (0.1-100 Hz) |
| Consistent decrease, e.g. $\lvert\Delta\theta\rvert > 10°$ | Approximately constant | CCW rotation | Frequency (0.1-100 Hz) |

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. In one such variation, for instance, the control unit may be operably connected to a pressure or contact sensor for detecting a pressure with which the skin contacting element is pressed against the skin, and be configured to control the motor to rotatably drive the rotor head in dependence of a pressure signal generated by the pressure sensor. Practically, this may enable the frequency of rotation or oscillation of the rotor head to be made dependent on the contact pressure, for example such that the frequency of rotation or oscillation is increased as the contact pressure increases, while rotation or oscillation of the rotor head ceases in case no skin contact is detected.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 skin treatment apparatus
10 hand-held base body
12 handle portion
14 rotor head housing portion
16 user control, e.g. on/off switch
20 rotor head
22 skin contacting element
24 bristle tuft
30 motor
40 motion sensor
50 control unit
60 battery
θ angular coordinate
L rotation axis of rotor head
R radial coordinate

The invention claimed is:

1. A skin treatment apparatus for treating a skin surface, comprising:

a hand-held base body;

a rotor head, movably connected to the hand-held base body, and including at least one skin contacting element;

a motor, operably connected to both the hand-held base body and the rotor head, and configured to rotatably drive the rotor head relative to the hand-held base body around a rotation axis;

at least one motion sensor, configured to generate a movement signal reflecting a path of relative movement between the hand-held base body and the skin surface; and a control unit, operably connected to the at least one motion sensor and the motor, and configured to control the motor to rotatably drive the rotor head in dependence of the movement signal of the at least one motion sensor.

2. The skin treatment apparatus according to claim 1, wherein the control unit is configured:

to distinguish a plurality of predetermined paths of relative movement;

to associate a different rotor head movement pattern with each of said distinguished predetermined paths of relative movement;

to repeatedly analyze the movement signal to detect one of the distinguished predetermined path of relative movement; and once a distinguished predetermined path of relative movement is detected during said analysis of the movement signal, to rotatably drive the rotor head in accordance with a rotor head movement pattern associated with the detected distinguished predetermined path of relative movement.

3. The skin treatment apparatus according to claim 2, wherein the control unit is configured to analyze timewise successive portions of the movement signal, each portion of the movement signal corresponding to a time interval of less than 1 second.

4. The skin treatment apparatus according to claim 2, wherein the control unit is configured to distinguish the plurality of predetermined paths of relative movement including linear paths of relative movement.

5. The skin treatment apparatus according to claim 4, wherein the control unit is further configured to distinguish between linear paths of relative movement extending in different directions with respect to a predetermined coordinate system fixed to the apparatus.

6. The skin treatment apparatus according to claim 2, wherein the control unit is configured to distinguish the plurality of predetermined paths of relative movement including circular paths of relative movement.

7. The skin treatment apparatus according to claim 6, wherein the control unit is further configured to distinguish between clockwise and counter-clockwise circular paths of relative movement.

8. The skin treatment apparatus according to claim 2, wherein the different rotor head movement patterns include at least two of:

a first rotor head movement pattern involving a clockwise rotation of the rotor head around a rotation axis of the rotor head;

a second rotor head movement pattern involving a counter-clockwise rotation of the rotor head around the rotation axis of the rotor head; and a third rotor head movement pattern involving an alternate clockwise and counter-clockwise rotation of the rotor head around the rotation axis of the rotor head.

9. The skin treatment apparatus according to claim 2, wherein the different rotor head movement patterns include:

a first rotor head movement pattern including a rotation or an oscillation of the rotor head at a first frequency; and a second rotor head movement pattern including a rotation or an oscillation of the rotor head at a second frequency different than the first frequency.

10. The skin treatment apparatus according to claim 1, wherein the at least one motion sensor is statically arranged relative to the hand-held base body.

11. The skin treatment apparatus according to claim 1, wherein the motor is a stepper motor.

12. The skin treatment apparatus according to claim 1, wherein the at least one motion sensor is a tracking device configured to generate a movement signal in accordance with movements of the hand-held base body across the skin surface detected.

13. The skin treatment apparatus according to claim 12, wherein the tracking device is an optical tracking device.

14. A method of treating a skin surface, comprising:

providing a skin treatment apparatus including:

a hand-held base body;

a rotor head, movably connected to the hand-held base body such that it is rotatable relative to the hand-held base body around a rotation axis, and including at least one skin contacting element;

moving the hand-held base body relative to the skin surface, and generating a movement signal that reflects a path of relative movement between the hand-held base body and the skin surface; and rotatably driving the rotor head in dependence of the movement signal, while the at least one skin contacting element touches the skin surface.

15. The method according to claim 14, further comprising:

distinguishing a plurality of predetermined paths of relative movement;

associating a different rotor head movement pattern with each of said distinguished predetermined paths of relative movement;

repeatedly analyzing the movement signal to detect one of the distinguished predetermined path of relative movement; and once a distinguished predetermined path of relative movement is detected during said analysis of the movement signal, rotatably driving the rotor head in accordance with a rotor head movement pattern associated with the detected distinguished predetermined path of relative movement.

* * * * *